US005834906A

United States Patent [19]

Chou et al.

[11] Patent Number: 5,834,906

[45] Date of Patent: Nov. 10, 1998

[54] INSTANT START FOR AN ELECTRONIC BALLAST PRECONDITIONER HAVING AN ACTIVE POWER FACTOR CONTROLLER

[75] Inventors: John Chou, Monterey Park; Yongping Xia; Feng Chang Hu, both of Torrance, all of Calif.

[73] Assignee: Philips Electronics North America Corporation, New York, N.Y.

[21] Appl. No.: 455,120

[22] Filed: May 31, 1995

[51] Int. Cl.[6] ..... H05B 41/36

[52] U.S. Cl. ..... 315/307; 315/DIG. 5; 315/247

[58] Field of Search ..... 315/247, DIG. 5, 315/219, DIG. 7, 307

[56] References Cited

U.S. PATENT DOCUMENTS

| | | | |
|---|---|---|---|
| 4,952,849 | 8/1990 | Fellows et al. | 315/307 |
| 5,214,355 | 5/1993 | Nilssen | 315/219 |
| 5,363,020 | 11/1994 | Chen et al. | 315/209 R |
| 5,402,043 | 3/1995 | Nilssen | 315/307 |
| 5,463,284 | 10/1995 | Mattas | 315/240 |
| 5,528,111 | 6/1996 | Konopka et al. | 315/291 |

OTHER PUBLICATIONS

"Power Factor Controller", pp. 1–11; Aug. 93Ref. 1.1 Feb. 1994 by LinFinity Microelectronics, Inc.

*Primary Examiner*—Robert Pascal
*Assistant Examiner*—Arnold Kinkead
*Attorney, Agent, or Firm*—Edward Blocker

[57] ABSTRACT

An electronic ballast for driving a fluorescent lamp includes an electromagnetic interference (EMI) filter and power circuit, a preconditioner coupled to the EMI filter and power circuit and an inverter circuit coupled to the preconditioner for energizing the fluorescent lamp. The preconditioner includes an active power factor controller and a boost circuit which is controlled at least in part by the active power factor controller. The active power factor controller has a reference voltage input to which is applied a reference voltage. At start up, the inverter provides a time varying signal which is rectified. At least a portion of the rectified signal is fed back to the reference voltage input of the active power factor controller to boost the reference voltage to a level above normal so that the active power factor controller will cause greater current to flow through the boost circuit, causing the boost circuit to generate a direct current (DC) rail voltage more rapidly, which rail voltage is provided to the inverter circuit to ignite and operate the fluorescent lamp.

16 Claims, 2 Drawing Sheets

INSTANT START FOR AN ELECTRONIC BALLAST PRECONDITIONER HAVING AN ACTIVE POWER FACTOR CONTROLLER

BACKGROUND OF THE INVENTION

1. Field of the Invention

The present invention relates to electronic ballasts, and more specifically relates to the preconditioner in an electronic ballast having an active power factor controller.

2. Description of the Prior Art

Electronic ballasts for driving lamp loads may employ a preconditioner for boosting the direct current (DC) rail voltage used in energizing the lamp driven by the electronic ballast. The preconditioner is conventionally turned on slowly by using a soft start circuit. The preconditioner is coupled to a parallel, resonant, current-fed half bridge high frequency inverter stage, which is driven by the constant DC rail voltage and which in turn provides high frequency power for operation of a lamp load, for example, a fluorescent lamp.

In conventional electronic ballasts, the DC rail voltage is slowly brought up to the desired operating point to where the inverter circuit is oscillating, resulting in a relatively long delay before stable operation of the lamp and associated circuit is achieved.

OBJECTS AND SUMMARY OF THE INVENTION

It is an object of the present invention to provide an electronic ballast having a preconditioner which is turned on as quickly as possible, resulting in a faster, stable operation of the lamp load driven by the electronic ballast.

It is a further object of the present invention to provide a method of rapidly igniting and operating a lamp load driven by an electronic ballast.

It is another object of the present invention to provide an electronic ballast which overcomes the inherent disadvantages of conventional electronic ballasts.

In accordance with one form of the present invention, an electronic ballast for driving a fluorescent lamp includes an electromagnetic interference (EMI) filter and power circuit, a preconditioner coupled to the EMI filter and power circuit and an inverter circuit coupled to the preconditioner for energizing the fluorescent lamp. The preconditioner includes an active power factor controller and a boost circuit which is controlled at least in part by the active power factor controller. The active power factor controller has a reference voltage input to which is applied a reference voltage. At start up, the inverter provides a time varying signal which is rectified. At least a portion of the rectified signal is fed back to the reference voltage input of the active power factor controller to boost the reference voltage to a level above normal so that the active power factor controller will cause greater current to flow through the boost circuit, causing the boost circuit to generate a direct current (DC) rail voltage more rapidly, which rail voltage is provided to the inverter circuit to ignite and operate the fluorescent lamp.

Also in accordance with the present invention, a method of rapidly generating a direct current (DC) rail voltage in an electronic ballast having a preconditioner and an inverter circuit and for minimizing the delay in igniting and operating a fluorescent lamp driven by the electronic ballast includes the steps of generating a time varying voltage signal in the inverter circuit, rectifying the time varying voltage signal to provide a rectified signal, applying at least a portion of the rectified signal for an initial predetermined period of time (i.e., during start up) to a reference voltage input of an active power factor controller forming part of the preconditioner, which causes an initial current to flow through a boost circuit also forming a part of the preconditioner, and applying an operating voltage reference signal to the reference voltage input during normal operation following start up, which causes a normal operational current to flow through the boost circuit.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

Figure 1:
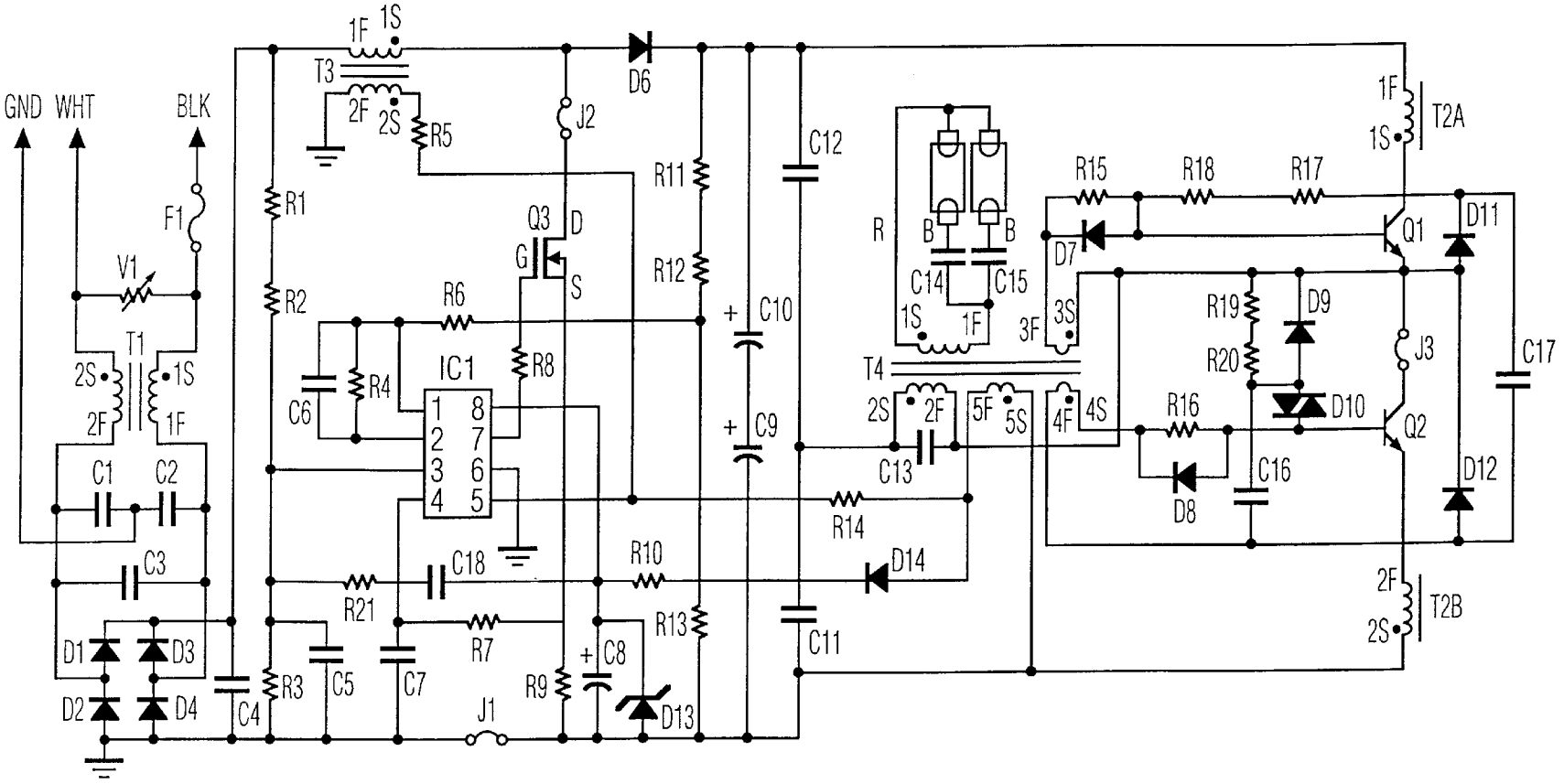
FIG. 1 is a schematic diagram of an electronic ballast formed in accordance with the present invention.

Referring initially to FIG. 1 of the drawings, it will be seen that an electronic ballast formed in accordance with the present invention includes three main sections—a filtering and power section, a preconditioner and an inverter stage which powers one or more fluorescent lamps or the like, or even other forms of electrical circuits.

The filtering and power section includes a varistor V1 situated across the AC power line (WHT and BLK). The varistor V1 provides transient protection for the electronic ballast.

The power lines (WHT and BLK) are provided to a common mode choke T1. Choke T1 acts as a filter for electromagnetic interference (EMI) and filters out common mode noise.

Choke T1 is also coupled to a series arrangement of capacitors C1 and C2. Capacitors C1 and C2 are bypass capacitors, which are used to bypass the noise to ensure that the noise does not get into the power line connected to the electronic ballast.

Capacitor C3 is situated in parallel with the series arrangement of capacitors C1 and C2. Capacitor C3 is a differential capacitor used for filtering.

The filtered signal from choke T1 and capacitors C1–C3 is now provided to a full wave rectifier circuit in a bridge configuration comprising diodes D1, D2, D3 and D4. As is shown in FIG. 1, the anodes of diodes D2 and D4 are grounded, and the cathodes of diodes D1 and D3 are coupled together and provide a full wave rectified signal. Capacitor C4 is connected between ground and the cathodes of diodes D1 and D3 and provides a short circuit for high frequencies.

For a 277 volt AC line voltage, the output voltage of the full wave rectifier, that is, the voltage across capacitor C4 is 277 volts RMS with a peak voltage of 390 volts. This voltage is provided to the preconditioner stage of the electronic ballast of the present invention.

More specifically, the preconditioner stage includes a boost choke T3, which is provided with the output voltage of the full wave rectifier circuit. The boost choke T3 is a key component of the preconditioner of the present invention. Choke T3 stores energy and forms part of a boost circuit which boosts the voltage up to a higher voltage which is used as the DC rail voltage for driving the inverter and the fluorescent lamps.

More specifically, boost choke T3 provides a boost function, and choke T3 is coupled to the anode of catch diode D6. The primary winding of boost choke T3 (that is, winding 1F–1S) is used to boost the voltage, and the secondary winding of choke T3 (that is, winding 2F–2S) is used in conjunction with integrated circuit IC1 to sense the zero crossing of the current through choke T3.

The boost circuit will boost the peak voltage from 390 volts, for example, to about 480 volts on the cathode of diode D6. The 480 volts constitutes the DC rail which is used to power the inverter circuit and the fluorescent lamps.

The cathode of catch diode D6 is connected to a resistor divider network comprising the series connection of resistors R11, R12 and R13. One end of resistor R13 is grounded, and the other end is provided to one end of resistor R6, as will be explained.

Although resistors R11 and R12 may be combined, they are separated here to divide the substantial DC rail voltage of 480 volts across the two resistors so that a single resistor will not have that full voltage drop across it, as the voltage across the resistors should not exceed approximately 350 volts (½ watt resistors are used for resistors R11 and R12).

The voltage seen at the juncture of resistors R13 and R6 is approximately 2.5 volts. The voltage signal across resistor R13, because of the resistor divider network, is proportional to the DC rail voltage. This signal is to be provided to integrated circuit IC1 through resistor R6.

Integrated circuit IC1 is a power factor controller, such as part number SG3561A manufactured by Linfinity Microelectronics, Inc., Garden Grove, Calif. The pin numbers associated with integrated circuit IC1 shown in FIG. 1 correspond to the pin numbers of the particular power factor controller mentioned above. The part specifications and application notes for the power factor controller mentioned above describe how the active power factor controller may be used in an electronic ballast.

Pin 1 of integrated circuit IC1 is connected to the inverting input of an error amplifier internal to circuit IC1, and the output of the error amplifier is connected to pin 2. Therefore, resistor R6 is the input resistor for the error amplifier, and resistor R4, which is connected across pins 1 and 2 of circuit IC1, acts as a feedback resistor for the internal error amplifier. Selection of resistors R6 and R4 will vary the gain of the error amplifier.

Capacitor C6 coupled in parallel with resistor R4 is used to frequency compensate the error amplifier internal to integrated circuit IC1.

The power factor controller IC1 drives a field effect transistor (FET), which acts as a switch for the boost circuit of the preconditioner. More specifically, pin 7 of integrated circuit IC1 is coupled to the gate of transistor Q3 through gate resistance R8. The source of transistor Q3 is coupled to one end of resistor R9, whose other end is grounded. Resistor R9 acts as a current sensing resistor to sense the current passing through transistor Q3 (which is also the current that passes through choke T3 when transistor Q3 conducts). Resistor R9 has a very small resistance, such as one ohm or less. The voltage dropped across resistor R9 is proportional to the current passing through FET switch transistor Q3. For example, if resistor R9 is one ohm, and there is a one volt drop across resistor R9, then one knows that one amp of current is passing through transistor Q3 when it is switched on.

Across the current sensing resistor R9 is the series connection of resistor R7 and capacitor C7. Resistor R7 and capacitor C7 act as a low pass filter. The low pass filter functions to filter out any current spikes present when transistor Q3 turns on. However, the normal current signal through transistor Q3 will pass through the low pass filter without significant attenuation.

The signal outputted by the low pass filter, that is, on the juncture of capacitor C7 and resistor R7, is provided to pin 4 of integrated circuit IC1. The power factor controller integrated circuit IC1 needs for its operation the current passing through the FET switch Q3 of the boost circuit (forming part of the preconditioner). Pin 4 leads to a comparator internal to integrated circuit IC1.

The signal provided on pin 4 of integrated circuit IC1 will have a triangular shaped waveform, as choke T3, which is an inductor, acts to limit the current passing through transistor switch Q3 and, therefore, the current increases substantially linearly and generates a triangular waveform on pin 4.

When transistor Q3 is switched on by integrated circuit IC1, current will pass through choke T3 and choke T3 will store energy. Integrated circuit IC1 will turn on transistor Q3 at the zero crossing of the current passing through choke T3, and this zero crossing is detected by the zero crossing detector internal to integrated circuit IC1.

Once the signal applied to pin 4 of integrated circuit IC1 reaches the designated peak value, integrated circuit IC1 will turn off transistor Q3. The magnetic field of boost choke T3 will then collapse, and the current will pass through catch diode D6 and into electrolytic capacitors C10 and C9 coupled in series, the series arrangement being connected to the cathode of catch diode D6 and ground. The voltage across capacitors C10 and C9 will increase due to the current being passed through it so that the voltage across the capacitors and at the cathode of catch diode D6 will be approximately 480 volts. This voltage will be the DC rail for driving the inverter and the fluorescent lamps powered by the electronic ballast of the present invention.

Capacitors C9 and C10 act as storage for the voltage boosted up to 480 volts. When diode D6 is off, the inverter will draw current from capacitors C10 and C9.

Integrated circuit IC1 will repeatedly turn on and turn off transistor Q3 in response to the current it senses passing through boost choke T3. Effectively, transistor Q3 is switched on and off by integrated circuit IC1 at a rate which varies between approximately 30 KHz and about 70 KHz. Integrated circuit IC1 controls and thereby shapes the waveform of current flowing through transistor Q3 so as to substantially eliminate any phase difference between line current and line voltage. A power factor for the ballast of almost unity (100%) results.

Thus, the preconditioner of the present invention provides the electronic ballast with a high power factor. If the preconditioner were not used, a capacitive load of capacitors C9 and C10 across the output of the full wave rectifier bridge would result in the line voltage lagging behind the line current. The power factor of the electronic ballast would then be very poor, that is, approximately 60%. With the preconditioner of the present invention, a power factor of almost 100% is provided as well as a DC rail which is increased in voltage.

The preconditioner of the electronic ballast of the present invention is coupled to the inverter stage, which is preferably a parallel, resonant, current-fed half bridge circuit. More specifically, the current-fed half bridge circuit includes capacitors C11 and C12 connected in series and across the DC rail voltage of 480 volts. Capacitors C11 and C12 are identical so that half the DC rail voltage would be dropped across each capacitor.

The ballast power, in other words, the power provided to the fluorescent lamps, is provided by a transformer T4 of the inverter circuit. The primary of transformer T4, at the winding defined by 2S–2F shown in FIG. 1, is connected to the juncture of capacitors C11 and C12. Across the primary winding 2S–2F is a capacitor C13. The primary winding and capacitor C13 form a tank circuit, which self oscillates at a resonant frequency of about 25 KHz.

More specifically, one end of capacitor C13 and the 2F side of the primary winding of transformer T4 are connected to the juncture of transistors Q1 and Q2 forming part of the inverter circuit. Transistors Q1 and Q2 will alternately turn on and off and will thus provide the tank circuit defined by the primary winding of transformer T4 and capacitor C13 with alternating current.

Transformer T4 is a step up transformer such that the secondary winding shown in FIG. 1 as between 1S and 1F generates a voltage of about 600 volts which is provided to the fluorescent lamps. This high voltage is needed to ignite the lamps. The voltage in the tank circuit formed by the primary winding of transformer T4 and capacitor C13 is about 240 volts, that is, about one half of the DC rail voltage.

Capacitors C14 and C15, which are connected to the secondary winding of transformer T4 and respectively to each of the fluorescent lamps, are balancing capacitors. Capacitors C14 and C15 provide an impedance which limits the current passing through the lamps.

Transformer T4 also includes two other windings, designated in FIG. 1 as 3F–3S and 4F–4S. These two windings provide positive feedback to the circuits which drive transistors Q1 and Q2 so that the inverter and in particular the transistors Q1 and Q2 can maintain their self oscillation.

More specifically, winding 3F–3S provides a driving current for transistor Q1. The winding is connected to resistor R15, whose other input is connected to the base of transistor Q1. Similarly, winding 4F–4S provides a driving current through resistor R16 to the base of transistor Q2.

Resistors R17 and R18, connected in series between the collector and base of transistor Q1 and, similarly, resistors R19 and R20, connected in series between the collector and base of transistor Q2, are used to trigger the oscillation of transistors Q1 and Q2 by providing a current path from the DC rail through the resistors R17–R20 to the base of transistors Q1 and Q2.

One end of resistor R19 is connected to the emitter of transistor Q1. Therefore, the current passing through transistor Q1 passes through resistors R19 and R20 and into capacitor C16 connected between the emitter of transistor Q2 and resistor R20 and will charge capacitor C16. Diac D10 is connected to the base of transistor Q2 and the juncture between resistor R20 and capacitor C16. When the voltage on capacitor C16 increases to about 40 volts, this will reach the breakdown voltage of diac D10. Diac D10 will breakdown, and the charge on capacitor C16 will pass through diac D10 into the base of transistor Q2, which will start transistor Q2 oscillating. Thus, windings 3F–3S and 4F–4S of transformer T4 help turn on the oscillation of transistors Q1 and Q2 and maintain these transistors oscillating.

Diodes D7 and D8 which are respectively in parallel with resistors R15 and R16 are provided to quickly turn off transistors Q1 and Q2. Any charge accumulating in the bases of transistors Q1 and Q2 may be removed quickly by diodes D7 and D8 rapidly conducting.

Diode D9, coupled between the diac D10 and the emitter of transistor Q1, which emitter is connected to the collector of transistor Q2, maintains capacitor C16 in a discharged state when transistor Q2 turns on so that diac D10 will not be triggered again. Diac D10 is used only to start transistor Q2 oscillating.

Diodes D11 and D12 are respectively connected across the collector and emitter of transistors Q1 and Q2. Diodes D11 and D12 are clamping diodes to remove spikes generated when transistors Q1 and Q2 turn on and off, so that the breakdown voltage of transistors Q1 and Q2 is never exceeded. Thus, diodes D11 and D12 protect transistors Q1 and Q2, respectively. Capacitor C17 connected from the collector of transistor Q1 to the emitter of transistor Q2 also provides protection by reducing the voltage spikes generated when transistors Q1 and Q2 switch states.

Transformer T2, having portions T2A and T2B, respectively with windings 1F–1S and 2F–2S, are connected respectively between the DC rail and the collector of transistor Q1 and the emitter of transistor Q2 and ground. Transformer portions T2A and T2B are provided to limit the current passing through transistors Q1 and Q2.

One of the features of the invention is the "instant start" capability of the electronic ballast. In other words, within about 100 msec of applying power to the electronic ballast, the fluorescent lamps will ignite and be operational.

The integrated circuit IC1, which is a power factor controller, operates in the electronic ballast to limit the peak current in response to the current sensed through resistor R9. When the ballast is first turned on capacitors C9 and C10 are uncharged and require a certain period of time to charge to about 480 volts. Consequently, the fluorescent lamps require as much as three to four times the energy to ignite as would be required during normal operation. The integrated circuit IC1 controls this energy at a normal level, and this level may be insufficient to immediately stabilize the DC rail voltage and start the fluorescent lamps. Accordingly, one of the functions of the electronic ballast of the present invention is to speed up the ignition of the fluorescent lamps, and it does this by adjusting the initial operation of the power factor controller, integrated circuit IC1, so that maximum energy is provided to quickly stablize the DC rail voltage and ignite the fluorescent lamps. With the present invention, the DC rail will rise to 480 volts very quickly.

In accordance with the present invention, pin 3 of integrated circuit IC1 is a reference voltage input and is connected to a voltage divider consisting of the series arrangement of resistors R1, R2 and R3 situated between the output of the full wave bridge rectifier and ground. Separate resistors R1 and R2 are preferably used to be within the maximum voltage specifications of the resistors. Capacitor C5 is connected in parallel with resister R3 to provide filtering. Resistors R1–R3 and capacitor C5 form a part of the preconditioner of the electronic ballast.

Pin 3 of integrated circuit IC1 is connected between the juncture of resistors R2 and R3 and, in normal operation, has about one volt applied to it by the resistor divider network. The voltage on pin 3 of integrated circuit IC1 determines the amount of current which will pass through choke T3 and FET switch Q3. In accordance with the invention, the initial current passing through choke T3 and transistor Q3 controlled by integrated circuit IC1 is boosted to a value which is much greater than normal operation by initially (at start up) increasing the voltage on pin 3 of integrated circuit IC1 to approximately 4 volts.

The preferred way of boosting this voltage on pin 3 of integrated circuit IC1 is by using an additional winding on transformer T4, which winding is designated by 5F–5S in FIG. 1. Approximately 20 volts at a frequency of about 25 KHz is provided by winding 5F–5S. The winding 5F–5S is connected to the anode of diode D14, which rectifies this signal, which rectified signal is then provided to resistor R10 which acts as a current limit. The other side of current limiting resistor R10 is coupled to the cathode of zener diode D13, whose anode is connected to ground. Diode D13 is preferably a 13 volt zener diode so that it regulates the voltage on one end of resistor R10 to 13 volts. This voltage is provided to the power input (Vcc) pin 8 of integrated circuit IC1. Capacitor C8 which is connected in parallel with zener diode D13 provides filtering. Resistor R14, connected between winding 5F–5S and pin 5 of circuit IC1, provides a trigger signal which is used to initiate the operation of the integrated circuit.

The voltage on pin 3 is boosted, in accordance with the present invention, by using a resistor/capacitor circuit comprising the series arrangement of capacitor C18 and resistor R21. One end of capacitor C18 is connected to resistor R10, and one end of resistor R21 is coupled to pin 3 of integrated circuit IC1.

At start up, the voltage signal provided by winding 5F–5S of transformer T4 is rectified by diode D14 and regulated by zener diode D13, and a portion of this voltage signal is passed through capacitor C18, which is initially uncharged, and through resistor R21 to pin 3 of integrated circuit IC1, boosting the voltage on pin 3 to approximately 4 volts. In response to this higher voltage, integrated circuit IC1 allows greater current to flow through choke T3 and transistor Q3.

Capacitor C18 then charges and, when fully charged, appears as an open circuit, cutting off the contribution of voltage provided from winding 5F–5S of transformer T4 to pin 3 of integrated circuit IC1. Accordingly, the voltage on pin 3 returns to its normal level of approximately 1 volt. Capacitor C18 and resistor R21 form an RC circuit which preferably has a time constant of about 10 to 20 msec.

Instead of powering up integrated circuit IC1 from choke T3, power is generated by tapping transformer T4. The reason for this is that, during the start up of the electronic ballast, the operation of choke T3 is very unstable because the current passing through choke T3 is controlled by FET switch Q3 which, in turn, is controlled by integrated circuit IC1 and, at start up, integrated circuit IC1 is not stable. However, the operation of transformer T4 during start up is stable, as it self-oscillates due to the inverter circuit. In other words, transformer T4 self-oscillates independently of integrated circuit IC1 and is not affected by the stability of integrated circuit IC1. Because transformer T4 is stable during start up, power for integrated circuit IC1 may be provided by winding 5F–5S of transformer T4. If integrated circuit IC1 were powered from choke T3, it would be initially unstable because of the low power (below that required for stable operation) provided to it by choke T3 on pin 8. The invention, on the other hand, overcomes this problem. Even though the DC rail may not be boosted to as high a voltage as required, the inverter circuit, incorporating transformer T4, will still oscillate, even though transformer T4 may not produce enough voltage to ignite the lamps.

It should be noted that in some conventional electronic ballasts, no boost circuit or preconditioner, including choke T3, is provided. The voltage from the full wave rectifier, i.e., 390 volts peak, is provided directly to a step-up transformer corresponding to transformer T4, which would boost the peak voltage from 390 volts to 600 volts in order to ignite the fluorescent lamps. If no active power factor controller is included, such as integrated circuit IC1, the power factor of the electronic ballast would be very poor, such as about 60%. With the active power factor controller integrated circuit IC1 forming part of the preconditioner of the electronic ballast, the power factor may be increased to almost unity, or 100%. Also, the instant start capability provided by capacitor C18 and resistor R21 boosts the voltage of the DC rail more quickly to provide the necessary energy for igniting the fluorescent lamps.

Figure 2:
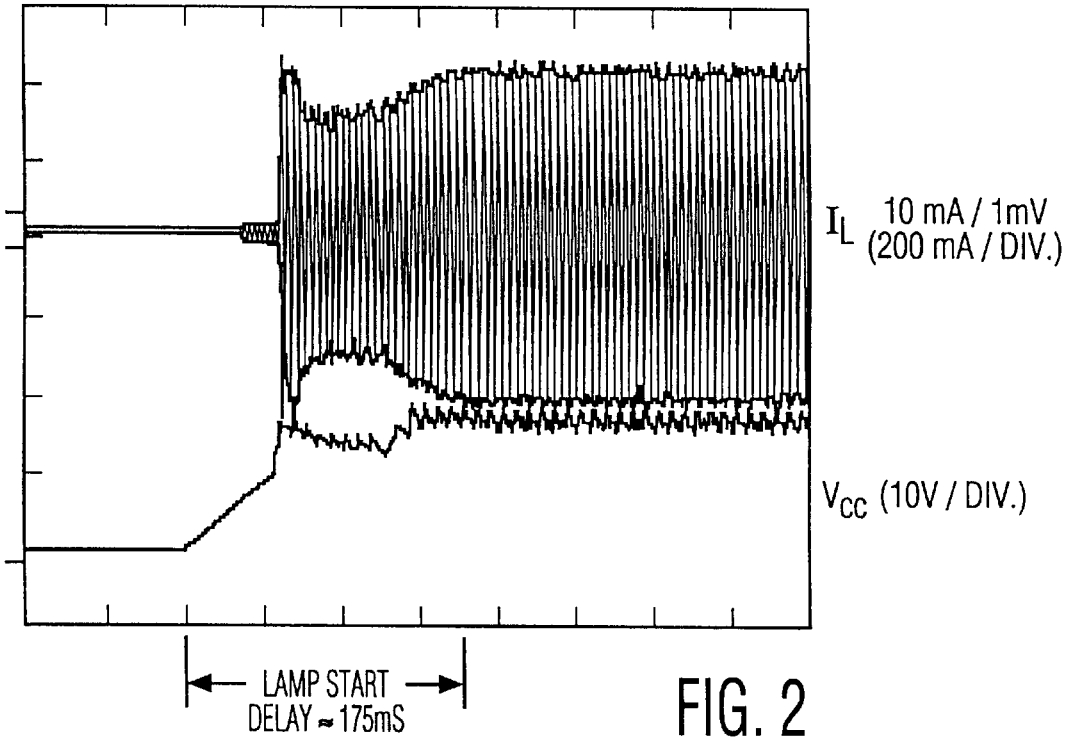
FIG. 2 is a plot of lamp current $I_L$ and circuit voltage (Vcc) versus time for a conventional electronic ballast illustrating the delay before stable lamp current is reached.

FIG. 2 is a graph of the lamp current, $I_L$, and circuit voltage, Vcc, versus time. The graph was taken from an oscilloscope display while testing an electronic ballast having an active power factor controller preconditioner but without the start circuit of the present invention formed by capacitor C18 and resistor R21. FIG. 2 shows a lamp start delay of approximately 175 msec between the time power (Vcc) is applied and stable operation of the fluorescent lamps is achieved.

Figure 3:
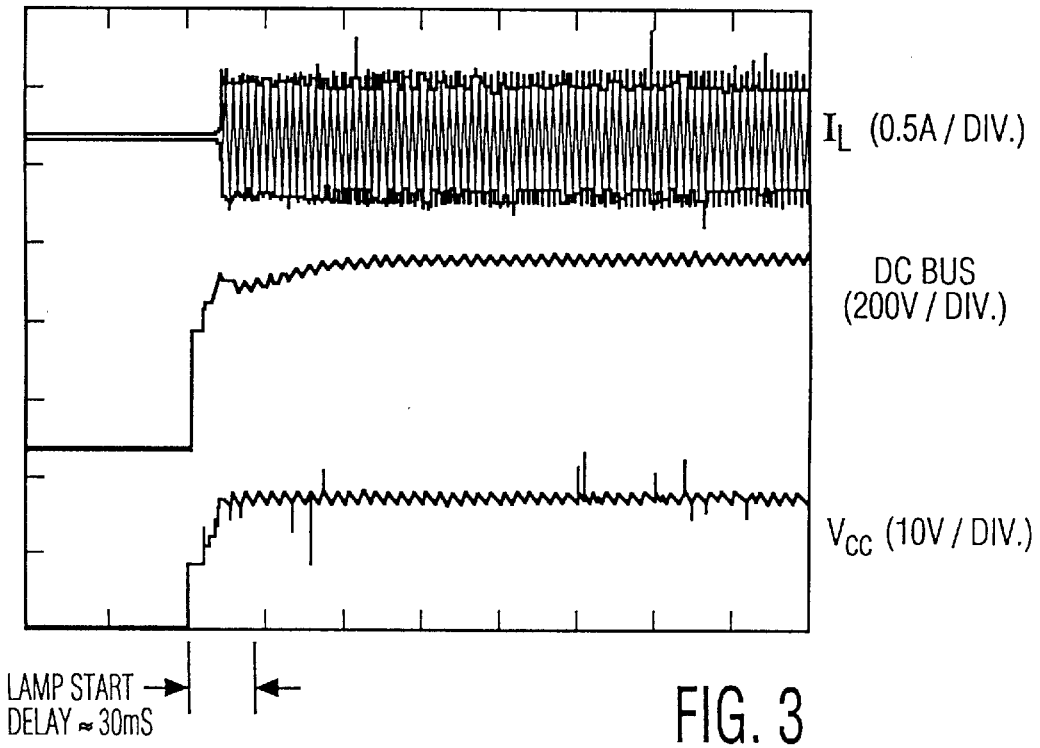
FIG. 3 is a graph of lamp current $I_L$, the direct current (DC) bus (i.e., DC rail) voltage and circuit voltage (Vcc) versus time for the electronic ballast of the present invention.

FIG. 3 is a similar graph taken from an oscilloscope display of lamp current, $I_L$, the DC bus (DC rail) voltage and the circuit voltage, Vcc, versus time, for an electronic ballast having an active power factor controller preconditioner with an instant start circuit formed in accordance with the present invention. FIG. 3 shows that there is significantly less delay, that is, approximately 30 msec, in achieving stable operation of the fluorescent lamps after start up.

The electronic ballast formed in accordance with the present invention not only provides a preconditioner to boost the DC rail voltage to a higher voltage for igniting the lamps by using an active power controller, but also significantly decreases the start-up time for the fluorescent lamps driven by the electronic ballast.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An electronic ballast for driving a fluorescent lamp which comprises:

an electromagnetic interference (EMI) filter and power circuit, the EMI filter and power circuit generating a full wave rectified signal;

a preconditioner including a boost circuit and an active power factor controller coupled to the boost circuit and at least partially controlling the operation thereof, the full wave rectified signal being provided to the boost circuit, the boost circuit generating a direct current (DC) rail voltage; and an inverter circuit responsive to the DC rail voltage and generating a stepped-up voltage for igniting and powering the fluorescent lamps, the inverter circuit further generating a second voltage signal which is supplied to the active power factor controller only during a start-up period of the lamp, the active power factor controller being responsive to the second voltage signal and controlling the boost circuit in response thereto to generate an elevated DC rail voltage provided to the inverter circuit.

2. An electronic ballast for driving a fluorescent lamp which comprises:

an electromagnetic interference (EMI) filter and power circuit, the EMI filter and power circuit generating a full wave rectified signal:

a preconditioner including a boost circuit and an active power factor controller coupled to the boost circuit and at least partially controlling the operation thereof, the full wave rectified signal being provided to the boost circuit, the boost circuit generating a direct current (DC) rail voltage; and an inverter circuit responsive to the DC rail voltage and generating a stepped-up voltage for igniting and powering the fluorescent lamp, the inverter circuit further generating a second voltage signal which is supplied to the active power factor controller only during a start-up period of the lamp, the active power factor controller being responsive to the second voltage signal and controlling the boost circuit in response thereto to generate an elevated DC rail voltage provided to the inverter circuit wherein the inverter circuit includes a step-up transformer, the step-up transformer having a winding on which is generated a time varying voltage signal; and wherein the electronic ballast further includes a voltage feedback circuit, the voltage feedback circuit including a rectifier, the rectifier being responsive to the time varying voltage signal provided by the transformer of the inverter circuit and generating a rectified signal in response thereto, the voltage feedback circuit further including means for providing for a predetermined period of time at least a portion of the rectified signal to the active power factor controller, the active power factor controller being responsive to the at least portion of the rectified signal and generating an output signal in response thereto, the output signal of the active power factor controller being provided to the boost circuit of the preconditioner, the boost circuit being responsive to the output signal of the active power factor controller and generating the DC rail voltage in response thereto.

3. An electronic ballast as defined by claim 2, wherein the means for providing at least a portion of the rectified signal to the active power factor controller includes a resistor/capacitor circuit having a resistor and a capacitor coupled together in series, the resistor/capacitor circuit being responsive to the rectified signal and providing at least a portion of the rectified signal to the active power factor controller.

4. An electronic ballast for driving at least one fluorescent lamp, which comprises:

an electromagnetic interference (EMI) filter and power circuit;

a preconditioner coupled to the EMI filter and power circuit; and an inverter circuit coupled to the preconditioner and to the at least one fluorescent lamp for providing power to the at least one fluorescent lamp;

the preconditioner including a boost circuit and an active power factor controller coupled to the boost circuit, the boost circuit including a boost choke, a catch diode coupled to the boost choke, a storage capacitor coupled to the catch diode, and an electronic switch coupled to the boost choke, the active power factor controller causing the electronic switch to be in a conductive and non-conductive state;

the active power factor controller having a reference voltage input which receives a first voltage signal for a start-up predetermined period of time and a second voltage signal for a normal operation period of time following the start-up predetermined period of time, the first voltage signal having a greater magnitude than the second voltage signal, the active power factor controller being responsive to the first and second voltage signals and controlling the conduction of the electronic switch and accordingly current passing through the boost choke in response thereto;

and wherein the inverter circuit includes a multiple winding step-up transformer coupled to the at least one fluorescent lamp, the multiple winding step-up transformer having a plurality of windings, at least one of the windings generating a time varying signal thereon;

and wherein the electronic ballast further comprises a feedback circuit, the feedback circuit including a rectifier coupled to the winding providing the time varying signal thereon, and a resistor/capacitor circuit, the rectifier being coupled to the resistor/capacitor circuit, the resistor/capacitor circuit including a capacitor and a resistor coupled in series, the feedback circuit being coupled to the reference voltage input of the active power factor controller and providing at least a portion of the first voltage signal to the reference voltage input of the active power factor controller in response to the time varying signal of the step-up transformer of the inverter circuit.

5. An electronic ballast for powering an electrical discharge lamp circuit, which comprises:

a filter and power circuit;

a preconditioner coupled to the filter and power circuit and including an active power factor controller and a voltage boost circuit at least partially controlled by the active power factor controller, the voltage boost circuit providing a direct current (DC) rail voltage to an inverter circuit; and the inverter circuit coupled to the preconditioner providing power to the electrical circuit;

wherein the inverter circuit generates a voltage, the voltage being fed back to the active power factor controller, the active power factor controller being responsive, during start-up, to the voltage to cause the voltage boost circuit to increase the voltage of the DC rail above its normal operation level for a short time interval sufficient to ignite the discharge lamp and wherein the voltage boost circuit comprises an inductor and a controlled switching element coupled to one another and to the filter and power circuit so that the controlled switching element controls current flow through the inductor, the active power factor controller controlling the operation of the controlled switching element independently of current flow in the discharge lamp circuit and powered by a signal which is based on the voltage generated by the inverter circuit.

6. An electronic ballast for powering an electrical discharge lamp circuit, which comprises:

a filter and power circuit;

a preconditioner coupled to the filter and power circuit and including an active power factor controller and a voltage boost circuit at least partially controlled by the active power factor controller, the voltage boost circuit providing a direct current (DC) rail voltage to an inverter circuit; and the inverter circuit coupled to the preconditioner providing power to the electrical circuit;

wherein the inverter circuit generates a voltage, the voltage being fed back to the active power factor controller, the active power factor controller being responsive, during start-up, to the voltage to cause the voltage boost circuit to increase the voltage of the DC rail above its normal operation level for a short time interval sufficient to ignite the discharge lamp and further comprising means for blocking the fed back voltage during a normal operation mode of the electronic ballast which occurs subsequent to the start-up time interval.

7. An electronic ballast for powering an electrical discharge lamp circuit, which comprises:

a filter and power circuit;

a preconditioner coupled to the filter and power circuit and including an active power factor controller and a voltage boost circuit at least partially controlled by the active power factor controller, the voltage boost circuit providing a direct current (DC) rail voltage to an inverter circuit; and the inverter circuit coupled to the preconditioner providing power to the electrical circuit;

wherein the inverter circuit generates a voltage, the voltage being fed back to the active power factor controller, the active power factor controller being responsive, during start-up, to the voltage to cause the voltage boost circuit to increase the voltage of the DC rail above its normal operation level for a short time interval sufficient to ignite the discharge lamp and wherein, during the start-up time interval, the inverter circuit supplies a DC operating voltage for the active power factor controller.

8. An electronic ballast for a discharge lamp comprising:

input terminals for connection to a source of supply voltage for the electronic ballast, a preconditioner circuit coupled to the input terminals and comprising a voltage boost circuit and an active power factor controller coupled to the voltage boost circuit so as to at least partly control the operation thereof, the voltage boost circuit in operation generating a DC rail voltage, an inverter circuit supplied by the DC rail voltage and adapted to be coupled to a discharge lamp for generating a voltage for igniting and operating the discharge lamp, wherein the inverter circuit generates a further voltage having a first voltage level during a start-up period of time for the discharge lamp, first means for supplying a control voltage of a second voltage level to a first control input of the active power factor controller, and second means for supplying said further voltage to the first control input of the active power factor controller which in response controls the voltage boost circuit to generate a higher DC rail voltage during the start-up period than it generates during a normal operation mode of the discharge lamp, thereby to speed up the ignition and operation of the discharge lamp.

9. The electronic ballast as claimed in claim 8 wherein the voltage boost circuit comprises an inductor and a controlled switching element connected in series to the input terminals so that the controlled switching element controls current flow through the inductor, the active power factor controller controlling the operation of the controlled switching element independently of current flow in the discharge lamp.

10. The electronic ballast as claimed in claim 9 wherein the active power factor controller includes a second control input responsive to current flow through the controlled switching element whereby the active power factor controller further controls the operation of the controlled switching element as a function of said current flow.

11. The electronic ballast as claimed in claim 10 wherein the second further means couples the control input of the active power factor controller to an input terminal so that the supply voltage further controls the operation of the active power factor controller and ultimately the operation of the controlled switching element.

12. The electronic ballast as claimed in claim 11 wherein said second means for supplying said further voltage comprises an RC circuit which blocks the supply of the further voltage to the control input of the active power factor controller subsequent to the start-up period.

13. The electronic ballast as claimed in claim 8 wherein said second means for supplying said further voltage comprises an RC circuit having a time constant that determines the length of the start-up period, said RC circuit being operative to block the supply of the further voltage to the control input of the active power factor controller at a time corresponding to said time constant.

14. The electronic ballast as claimed in claim 8 wherein, during the start-up period, the inverter circuit supplies a DC operating voltage for the active power factor controller.

15. The electronic ballast as claimed in claim 1 wherein, during the start-up period, the inverter circuit supplies a DC operating voltage for the active power factor controller.

16. The electronic ballast as claimed in claim 8 wherein the voltage boost circuit comprises an inductor and a controlled switching element coupled to the input terminals, and wherein the active power factor controller includes a second control input responsive to a voltage determined by current flow through the controlled switching element whereby the active power factor controller, during the start-up period, is controlled by said further voltage and by the current flow determined voltage, and the inverter circuit supplies a DC operating voltage for the active power factor controller.

* * * * *